US007228195B2

(12) United States Patent
Hagino

(10) Patent No.: US 7,228,195 B2
(45) Date of Patent: Jun. 5, 2007

(54) EMBROIDERY MACHINE AND EMBROIDERY SYSTEM

(75) Inventor: Seiichiro Hagino, Chiryu (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 11/214,727

(22) Filed: Aug. 31, 2005

(65) Prior Publication Data

US 2006/0060115 A1 Mar. 23, 2006

(30) Foreign Application Priority Data

Sep. 21, 2004 (JP) ..... 2004-273664

(51) Int. Cl.
*D05C 3/00* (2006.01)

(52) U.S. Cl. ..... 700/138; 112/78

(58) Field of Classification Search ..... 700/138, 700/136, 137, 130
See application file for complete search history.

(56) References Cited

U.S. PATENT DOCUMENTS 5,904,109 A * 5/1999 Asano ..... 700/138
6,012,402 A * 1/2000 Sekine ..... 112/102.5

FOREIGN PATENT DOCUMENTS

JP 2004-129947 4/2004

OTHER PUBLICATIONS

U.S. Appl. No. 11/214,727, filed Aug. 31, 2005, Hagino.
U.S. Appl. No. 11/217,463, filed Sep. 2, 2005, Hagino.

* cited by examiner

*Primary Examiner*—Danny Worrell
(74) *Attorney, Agent, or Firm*—Oblon, Spivak, McClelland, Maier & Neustadt, P.C.

(57) ABSTRACT

An embroidery machine includes a plurality of thread reel stand bars, a plurality of thread reels installed to the thread reel stand bars, respectively, a plurality of needles to which threads are supplied from the respective thread reels, at least two of the needles being selected to operate, on the basis of an embroidery data, in order for forming a stitch pattern of multiple colors, a wireless tag attached to each of the thread reels an having information related to the thread wound therearound, and a receiving device, for reading the information in the wireless tag, provided at each of the thread reel stand.

4 Claims, 5 Drawing Sheets

FIG. 7

Thread data table

| Code | Brand | Description | Thickness | R | G | B |
|---|---|---|---|---|---|---|
| 1 | Default | Green | 120 | 0 | 255 | 0 |
| 2 | Default | Blue | 120 | 0 | 0 | 255 |
| 3 | Default | Red | 120 | 255 | 0 | 0 |
| 4 | Default | Yellow | 120 | 255 | 255 | 0 |
| 5 | Default | Cyan | 120 | 0 | 255 | 255 |
| 6 | Default | Magenta | 120 | 255 | 0 | 255 |
| 7 | Default | Dark Green | 120 | 0 | 153 | 0 |
| 8 | Default | Dark Blue | 120 | 0 | 0 | 153 |
| 9 | Default | Dark Red | 120 | 153 | 0 | 0 |
| 10 | Default | Orange | 120 | 255 | 153 | 51 |
| 11 | Default | Purple | 120 | 153 | 0 | 204 |
| 12 | Default | Brown | 120 | 153 | 102 | 51 |
| 13 | Default | White | 120 | 255 | 255 | 255 |
| 14 | Default | Black | 120 | 0 | 0 | 0 |
| 15 | Default | Pink | 120 | 255 | 126 | 204 |
| 16 | Default | Sand | 120 | 255 | 204 | 126 |
| 17 | Default | Turquoise | 120 | 102 | 255 | 204 |
| 18 | Default | Grey | 120 | 102 | 102 | 102 |
| 19 | Default | Khaki | 120 | 153 | 153 | 102 |
| 20 | Default | Powder Blue | 120 | 126 | 126 | 255 |
| 21 | ABC | White | 75 | 255 | 255 | 255 |
| 22 | ABC | Parchment | 75 | 255 | 255 | 250 |
| 23 | ABC | Yellow | 75 | 255 | 255 | 0 |
| 24 | ABC | Mid Gold | 75 | 255 | 230 | 75 |
| 25 | ABC | Darker Gold | 75 | 245 | 240 | 102 |
| 26 | ABC | Orange Gold | 75 | 255 | 245 | 0 |
| 27 | ABC | Dark Brown | 75 | 153 | 102 | 51 |
| 28 | ABC | Night Brown | 75 | 135 | 90 | 45 |
| 29 | ABC | Orange | 75 | 255 | 125 | 0 |
| 30 | ABC | Red | 75 | 255 | 0 | 0 |
| 31 | ABC | Dark Red | 75 | 204 | 0 | 0 |
| 32 | ABC | Brown Fox | 75 | 204 | 51 | 0 |
| 33 | ABC | Plum | 75 | 175 | 0 | 75 |
| 34 | ABC | Dark Plum | 75 | 135 | 0 | 51 |
| 35 | ABC | Plum Pink | 75 | 204 | 140 | 150 |
| 36 | ABC | Mauve Pink | 75 | 255 | 204 | 215 |
| 37 | ABC | Marine Blue | 75 | 51 | 0 | 204 |
| 38 | ABC | Navy | 75 | 0 | 0 | 102 |
| 39 | ABC | Medium Blue | 75 | 150 | 190 | 230 |
| 40 | ABC | Teal Green | 75 | 60 | 175 | 120 |
| 41 | ABC | Dark Leaf Green | 75 | 0 | 115 | 80 |
| 42 | ABC | Light Grey Brown | 75 | 245 | 235 | 204 |
| 43 | ABC | Brownish Green | 75 | 125 | 90 | 50 |
| 44 | ABC | Gold | 75 | 240 | 204 | 145 |
| 45 | ABC | Light Grey Brown | 75 | 204 | 204 | 185 |
| 46 | ABC | Dark Grey | 75 | 127 | 127 | 127 |
| 47 | ABC | Silver Grey | 75 | 178 | 178 | 178 |
| 48 | ABC | Black | 75 | 0 | 0 | 0 |

EMBROIDERY MACHINE AND EMBROIDERY SYSTEM

CROSS REFERENCE TO RELATED APPLICATIONS

This application is based on and claims priority under 35 U.S.C. § 119 to Japanese Patent Application 2004-273664, filed on Sep. 21, 2004, the entire content of which is incorporated herein by reference.

FIELD OF THE INVENTION

This invention generally relates to an embroidery machine and an embroidery system including the embroidery machine. More particularly, this invention pertains to an embroidery machine including multiple needles to which different threads are supplied from different thread reels respectively and respectively utilized in turn repeatedly for forming a stitch pattern of plural colors.

BACKGROUND

JP2004-129947A describes a conventional embroidery machine including multiple needles and a thread-changing mechanism. In the conventional embroidery machine, thread information such as colors of the threads supplied to respective needles are inputted to a personal computer by means of a keyboard, mouse, or other input device. The personal computer inquires matching between the thread information and an embroidery data of an embroidery pattern. Then, when the color of the thread indicated by the thread information is different from the color of the thread indicated by the embroidery data or the like, the personal computer automatically corrects a thread color indicated in the embroidery data on the basis of the inquiry result. In other words, in the embroidery machine, color of embroidery is changed.

However, manual input for thread color data in terms of RGB, thread material data, and thread thickness data is troublesome works. In particular, in the embroidery machine in which different threads are supplied from the plural thread reels, the amount of input data in relation to the thread information becomes large.

A need thus exists for an embroidery machine enabling labor saving of inputting thread information. It is preferable that correct input of thread information is available. It is further preferable that input system of thread information can be configured compact by efficiently utilizing structure property of the embroidery machine. A need thus also exists for an embroidery system including the embroidery machine described above. The present invention has been made in view of the above circumstances and provides such an embroidery machine and an embroidery system.

SUMMARY OF THE INVENTION

According to an aspect of the present invention, an embroidery machine includes a plurality of thread reel stand bars, a plurality of thread reels installed to the thread reel stand bars respectively, a plurality of needles to which threads are supplied from the respective thread reels and operated in turn in order for forming a stitch pattern of multiple colors on the basis of an embroidery data, a wireless tag attached to each of the thread reels having information of one of the threads wound around each of the thread reels, and a receiving means provided at each of the thread reel stand bars for reading the information retained by the each wireless tag.

According to a further aspect of the present invention, an embroidery system includes one embroidery machine or a plurality of embroidery machines of automatic thread-changing type equipped with multiple needles including a receiving means for receiving an identification of a thread wound around a thread reel from a wireless tag attached to the thread reel for retaining the identification of the thread, a server device connected to the one embroidery machine or the plurality of the embroidery machines of automatic thread-changing type equipped with multiple needles through a network, a database provided at an internal memory device or an external memory device of the server device for storing the identification of the thread and associated thread information, and a searching means provided at the server device for searching the database for the identification of the thread received by the receiving means.

BRIEF DESCRIPTION OF THE DRAWINGS

The foregoing and additional features and characteristics of the present invention will become more apparent from the following detailed description considered with reference to the accompanying drawings, wherein:

FIG. 7 represents a table indicating an example of thread information utilized in the embroidery system according to the embodiment of the present invention.

DETAILED DESCRIPTION

Figure 1:
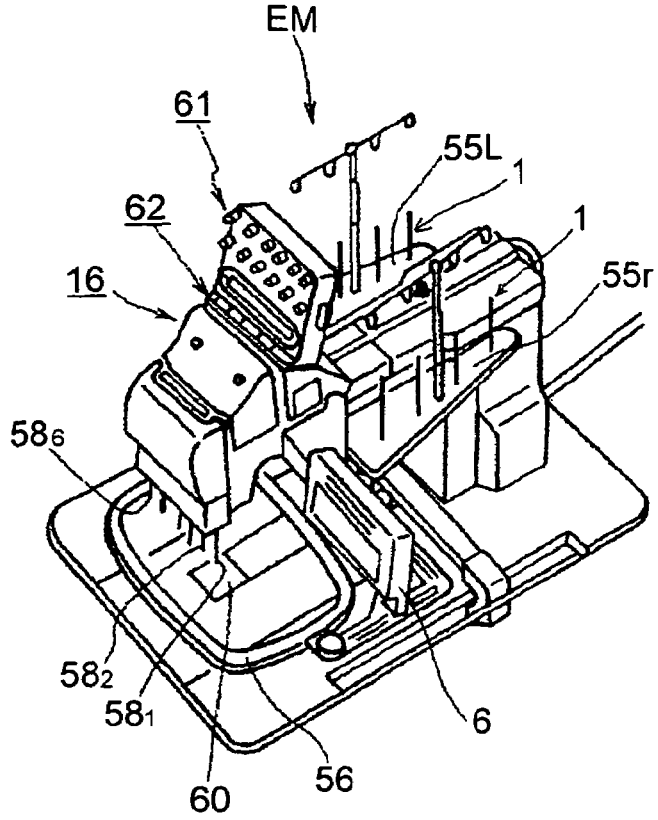
FIG. 1 represents a block diagram illustrating an embroidery system including an embroidery machine according to an embodiment of the present invention.

An embodiment of the present invention will be explained. In the embodiment of the present invention, when a thread reel to which a wireless tag is attached in advance is installed to a thread reel stand bar of one embroidery machine or a plurality of embroidery machines equipped with multiple needles and of automatic thread-changing type having a receiving device for receiving signals from the wireless tag, the embroidery machine reads an identification (ID) of the thread wound around the thread reel through the receiving device. Then, the embroidery machine searches a database of thread ID and associated thread information stored in a server PC provided in a network for finding the thread ID and obtaining the associated thread information from the database.

The thread information to be obtained includes a manufacturer of the thread, a thread color (indicated by number or RGB code), material of thread (rayon, polyester or the like), or a thread thickness. In the system described above, the thread information can firmly be obtained in simple way. Then, the system can be set up, or controlled more stably, which can contribute to improve operationality and productivity.

In the embodiment of the present invention, following operations are performed corresponding to the obtained thread information.

Operation in relation to thread color information (Assign RGB code to each needle of the embroidery machine): The system compares the thread color information of obtained one with one incorporated in an embroidery data included in a server device in terms of RGB codes. Then, the system selects a needle (needle number) to which a thread having a color identical with or similar to that indicated by the RGB code incorporated in the embroidery data is supplied, and set the selected needle to operation position.

Operation in relation to thread material (such as rayon, polyester): on the basis of the thread material information, the system controls a thread tension regulator or timing for moving an XY frame to which a cloth is attached. Thus, quality of stitches can be controlled, or cut-off of thread can be prevented.

Operation in relation to thread thickness: on the basis of the thread thickness information, the thread tension regulator is controlled, or thread density in the embroidery data is adjusted to appropriate value.

In the embodiment of the present invention, the thread reel includes a hollow core into which a thread reel stand bar is inserted. The wireless tag is attached to an inner wall of the hollow core.

In the embodiment of the present invention, on the basis of a search result obtained by the searching means, thread information, in other words, one or more commands such as thread change command, thread tension regulator change command, and thread density change command is/are transmitted from the server device to the one embroidery machine or a plurality of embroidery machines.

In the embodiment of the present invention, when a color different from those of threads supplied to the needles is assigned in the embroidery data, the assigned color in the embroidery data is assumed to the most resemble color of the thread among those supplied to the needles.

An example will be explained with reference to drawing figures.

FIG. 1 represents an explanatory diagram illustrating structure of an embroidery machine according to an embodiment of the present invention.

With reference to FIG. 1, an embroidery machine EM includes a conventional frame-driving means for driving and moving an embroidery frame 56 in two dimensional direction along a horizontal plain (X-direction and Y-direction), a conventional needle mechanism for vertically driving needles $\mathbf{58}_1$–$\mathbf{58}_6$ located above a piercing hole 60, a conventional needle-selecting device 16 similar to one described in JPS53-043336A or JPS55-008626A or the like, and thread reel stand tables 55 (55*r*, 55L).

The needle-selecting device 16 selects one of the needles $\mathbf{58}_1$–$\mathbf{58}_6$ and set the selected needle right above the middle of the piercing hole 60. Then, a thread supplied to the needle located right above the piercing hole 60 is utilized for embroidering.

Plural thread reel stand bars 1 are provided upright on the thread reel stand tables 55*r*, 55L. The plural thread reels (bobbins) can be provided regularly on the thread stand tables 55*r*, 55L.

Among the plural thread reels, a thread wound around each predetermined thread reel is applied to each predetermined needle $\mathbf{58}_1$–$\mathbf{58}_6$ through each thread tension regulator 61, each hole of a thread guide plate 62, and each hole of a thread take-up lever.

Figure 2:
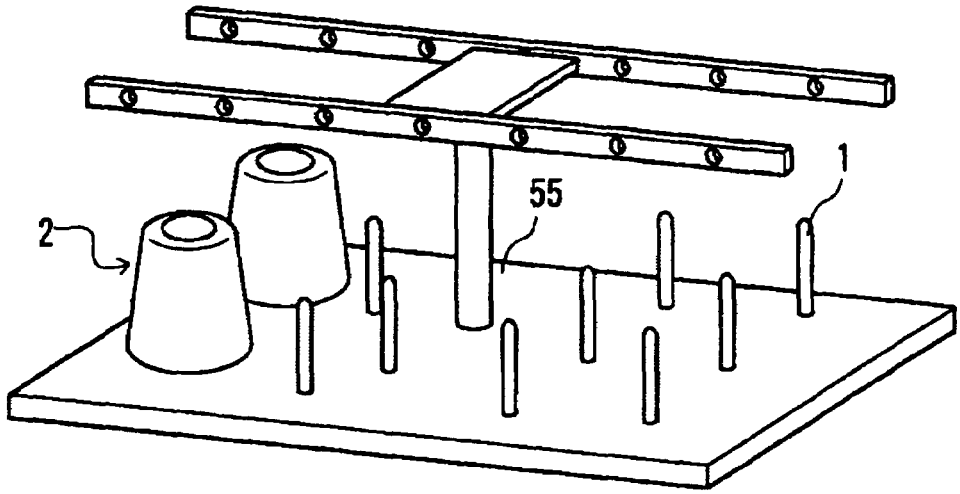
FIG. 2 represents a schematic diagram illustrating a thread reel installed to a thread reel stand bar in the embroidery machine illustrated in FIG. 1.
Figure 3:
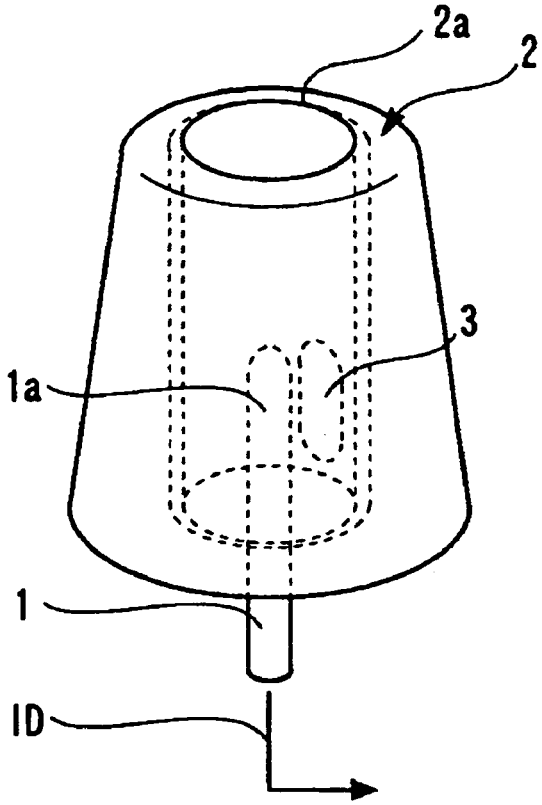
FIG. 3 represents a schematic diagram illustrating a wireless tag attached to the thread reel and a receiving means (antenna) accommodated in the thread reel stand bar.

FIG. 2 represents a schematic diagram illustrating a thread reel installed to a thread reel stand bar. FIG. 3 represents a schematic diagram illustrating a wireless tag attached to the thread reel and an antenna (receiving means) accommodated in the thread reel stand bar.

With reference to FIGS. 2 and 3, the wireless tag 3 retaining a thread ID is attached to an inner core (hollow core) 2*a* of the thread reel 2. Receiving means 1*a* for receiving the thread ID retained in the wireless tag 3 are provided at the plurality of thread reel stand bars 1 to which the thread reels 2 are installed. When the wireless tag 3 receives electromagnetic wave emitted from the receiving means 1*a*, the wireless tag 3 emits a signal indicating the thread ID. The receiving means 1*a* receives the signal, and send the signal indicating the thread ID to a controller 6 (illustrated in FIG. 1) of the embroidery machine EM.

Next, an embroidery system including the embroidery machine described above will be explained.

Figure 4:
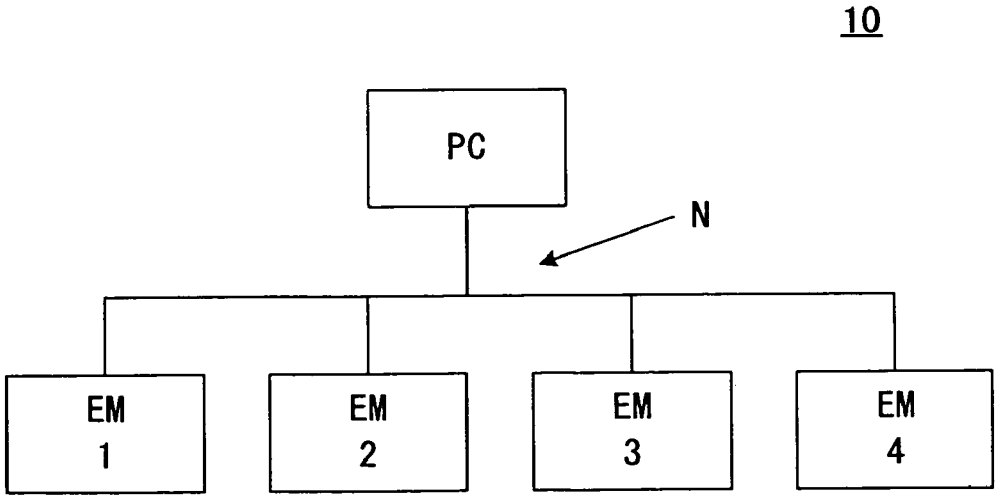
FIG. 4 represents a block diagram illustrating an embroidery system including the embroidery machine illustrated in FIG. 1.

FIG. 4 represents a block diagram illustrating an embroidery system including the embroidery machines.

With reference to from FIG. 1 to FIG. 4, the embroidery system 10 includes plural embroidery machines EM. The embroidery machines are equipped with multiple needles and a thread-changing system. Each embroidery machine includes the receiving means 1*a* provided at the thread reel stand bar 1 for receiving the ID emitted from the wireless tag 3 attached to the thread reel 2 and retaining the ID of the thread wound around the thread reel 2. The embroidery system further includes a server device connected to the plural embroidery machines EM through a network N.

Figure 5:
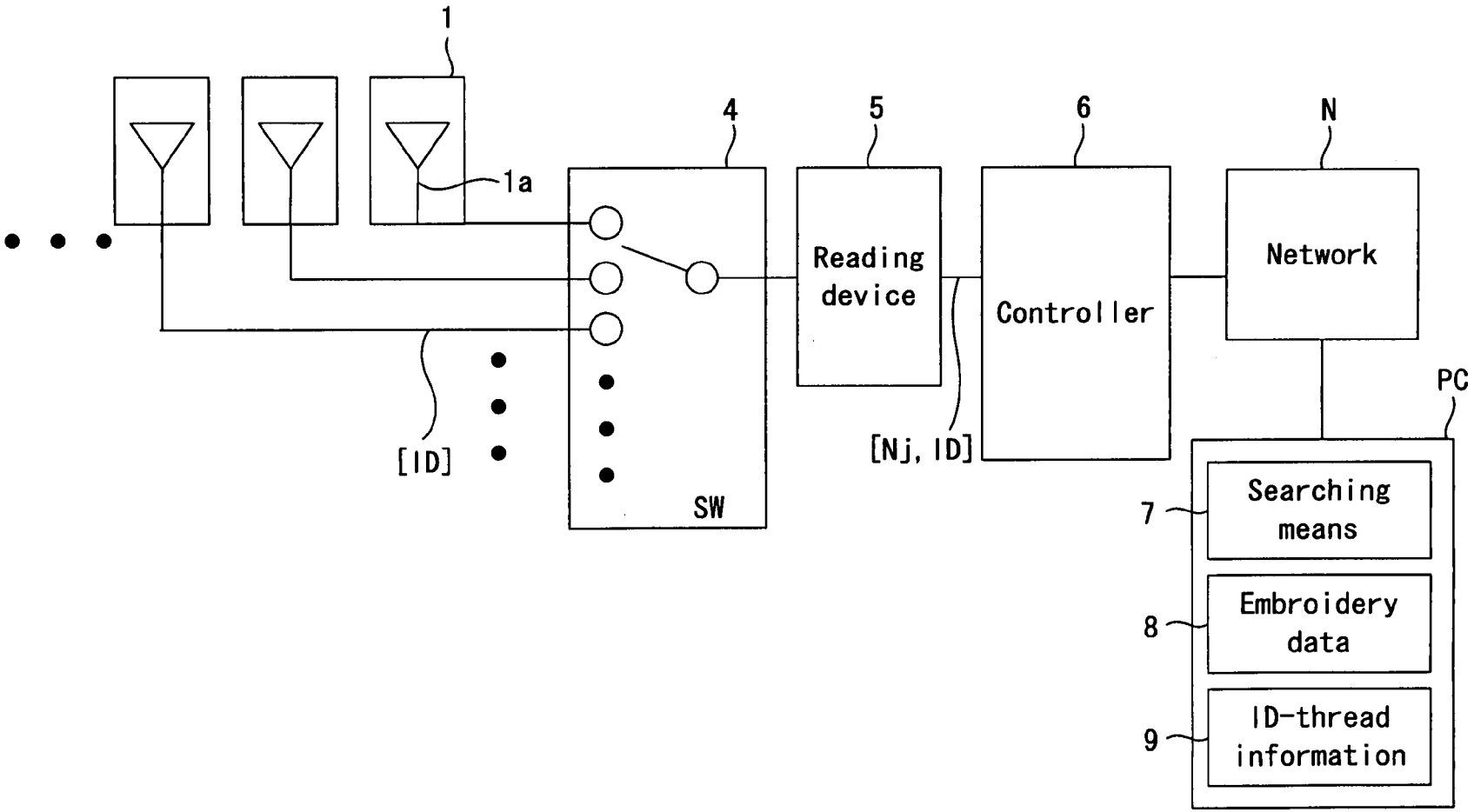
FIG. 5 represents a block diagram for explaining actions of the embroidery system illustrated in FIG. 4.

With reference to FIG. 4, an internal memory device or an external memory device of the server device PC stores embroidery information of several kinds of embroidery pattern, in other words, embroidery data 8 (illustrated in FIG. 5). The embroidery pattern is specified by a specific name (file name). The embroidery information of each pattern specified by the specific name (file name) is configured from several control data and a large number of stitch data. The control data includes required thread color data Ci and thread selection sequence data.

On the basis of the embroidery data transmitted from the server device PC, the plural embroidery machines EM are driven simultaneously (in some cases, one is driven after a predetermined period of time from another) for forming a predetermined pattern of multiple colors on a cloth (not illustrated) attached to the embroidery frame (56 of FIG. 1).

The stitch data includes two kinds of data. One is a control data including thread-changing command data and end (end of embroidery) command data. Second is a data indicating the required amount of driving and moving the embroidery frame (moving distance along X-axis and Y-axis) from the last position of the embroidery frame (at a start time, the middle of the frame is positioned right above the piercing hole 60).

In the stitch data, data of the amount of driving and moving the embroidery frame are sequentially arranged in the unit of 1 stitch, during embroidery and if there are no thread changes. If thread changes are required for certain timings, thread-changing command data are inserted at appropriate locations of the stitch data. Then, an end command data is located at timing for ending embroidery, in other words, at the end of the stitch data. For indicating thread colors described above, RGB codes are employed.

Further, the server device PC includes a thread information database 9 (illustrated in FIG. 5) storing thread IDs associated with thread information and a searching means 7 for finding thread information corresponding to the thread ID received by the receiving portion (1*a* in FIG. 3) from the thread information database 9. In addition, the searching means 7 can be configured from a program operable by the server device PC.

Figure 6:
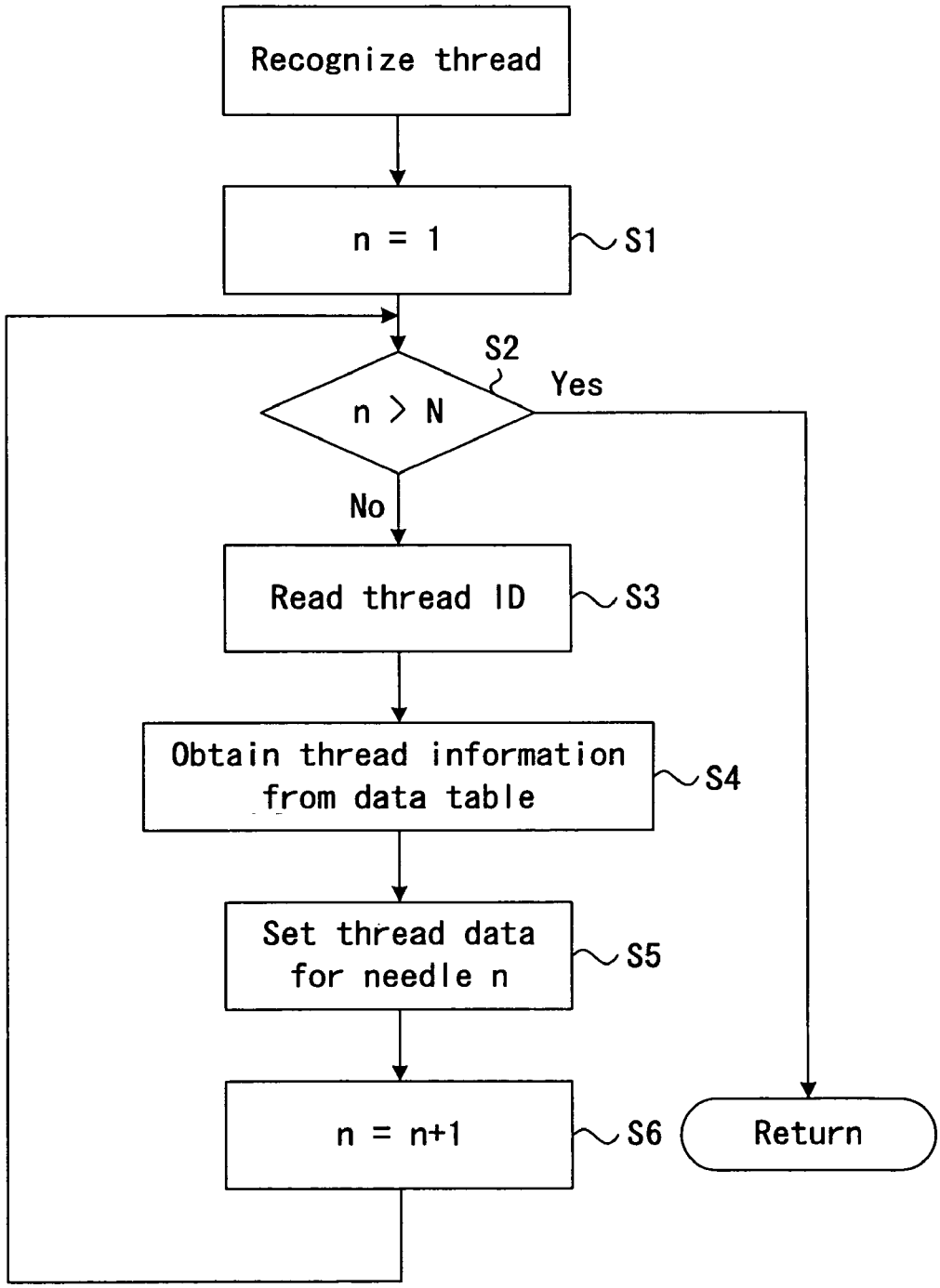
FIG. 6 represents a flowchart for explaining procedures of recognizing thread information in the embroidery system illustrated in FIG. 5.

FIG. 5 represents a block diagram for explaining actions of the embroidery system illustrated in FIG. 4. FIG. 6 represents a flow chart for explaining procedures of recognizing thread information in the embroidery system illustrated in FIG. 5. FIG. 7 represents a table for indicating an example of thread information.

With reference to FIG. 5, the embroidery system according to the embodiment of the present invention includes one embroidery machine or plural embroidery machines EM equipped with multiple needles and of automatic thread-changing type having the receiving means 1*a* for receiving the ID emitted from the wireless tag 3 (illustrated in FIG. 3) attached to the thread reel 2 and retaining the ID of the thread wound around the thread reel 2, the server device PC connected to one embroidery machine or the plural embroidery machines EM through the network N, the thread information database 9 provided at the internal memory device or the external memory device of the server device PC and storing the thread ID associated with thread information, and the searching means 7 provided at the server device PC for searching and finding the thread ID received by the receiving means 1*a* from the thread information database 9.

Further, the embroidery system according to the embodiment of the present invention includes a switch 4 and a reading device 5 provided in the embroidery machine EM between the receiving means 1*a* and the controller 6 arranged in an order described above. The connection of the switch 4 is switched on the basis of control signals transmitted from the reading device 5. The thread ID received by the receiving means 1*a* is transmitted to the server device PC with information of a needle number and a thread reel number through the controller 6.

With reference to FIGS. 3 to 6, method for obtaining thread information performed in the embroidery system according to the embodiment of the present invention will be explained.

First, the thread reel 2 is installed to the thread reel stand bar 1. Then, the controller 6 and the server device PC of the embroidery machines EM are started.

Steps S1 to S3 will be explained with reference to FIG. 6. First, the receiving means 1*a* accommodated in the thread reel stand bar 1 for supplying thread to a first needle $\mathbf{58}_1$ emits a predetermined electromagnetic wave. Then, the wireless tag 3 attached to the thread reel 2 installed to the thread reel stand bar 1 emits a signal of the ID of the thread wound around the thread reel 2. The receiving means 1*a* receives the signal of the ID emitted by the wireless tag 3.

Steps S4 and S5 will be explained with reference to FIG. 6. The thread ID is transmitted together with the needle number or the thread reel number (Nj) in the form of pair data [Nj, ID] (j=1 to 6) to the server device PC through the reading device 5, the controller 6, and the network N. The searching means 7 of the server device PC searches the thread information database 9 for the ID of the thread supplied to the needle $\mathbf{58}_1$ (illustrated in FIG. 7) for obtaining the thread information of the thread supplied to the needle $\mathbf{58}_1$, for example, manufacturer of the thread, thread color (RGB), and thread thickness.

The searching means 7 transmits the thread information to the controller 6. Then, requests of changes for such as thread, a thread tension regulator and thread density is displayed on the required basis. In addition, independently, on the basis of the search result of the searching means 7, the embroidery data 8 stored in the server device PC can be corrected.

Steps S6 and S1 will be explained with reference to FIG. 6. The switch 4 is sequentially switched on the basis of the control signals transmitted from the reading device 5. Actions described above are repeated for the needles $\mathbf{58}_1$ to $\mathbf{58}_6$ or for all of the thread reels 2. The number of repeating the actions is according to the number of the needles $\mathbf{58}_1$ to $\mathbf{58}_6$ or the number of the thread reels 2. Then, the thread information of entire thread reels 2 can be obtained.

The controller 6 transmits the signal in relation to [Nj, ID] to the server device PC through the network N.

The searching means 7 searches the thread information database 9 for the thread ID included in [Nj, ID] associated with the thread information recorded in the server device PC. The server device PC can transmit the thread information such as thread change command, thread tension regulator change command, or thread density change command to the embroidery machine EM on the basis of the search results.

The embroidery system according to the embodiment of the present invention can be applied to an embroidery machine equipped with multiple needles and of thread-changing type, in particular, an embroidery machine equipped with multiple needles and of automatic thread-changing type. Further, the embroidery system according to the embodiment of the present invention can be applied to an embroidery system including the embroidery machines connected and utilized in parallel. Further, the embroidery system according to the embodiment of the present invention can be applied to a knitting machine and knitting system requiring automatic changes of various threads.

According to the embodiment of the present invention, a wireless tag having thread information such as color, thickness, and material of a thread is attached to a thread reel, and a receiving means for reading the thread information is provided at a thread reel stand bar of a main body of an embroidery machine to which the thread reel is installed. Accordingly, labor saving for inputting thread information to the embroidery machine becomes possible. Further, the thread information can be correctly inputted to the embroidery machine. In addition, because a wireless input system of the thread information is configured from the thread reel stand bar and the thread reel, the wireless tag and the receiving means (antenna) can be closely located, which can enhance a degree of precision of reading. Further, owing to the same reason, remodeling work required for constructing the wireless input system can be made small.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An embroidery machine comprising:

a plurality of thread reel stand bars;

a plurality of thread reels installed to the thread reel stand bars, respectively;

a plurality of needles to which threads are supplied from the respective thread reels, at least two of the needles being selected to operate, on the basis of an embroidery data, in order for forming a stitch pattern of multiple colors;

a wireless tag attached to each of the thread reels and having information related to the thread wound therearound; and receiving means, for reading the information in the wireless tag, provided at each of the thread reel stand bars.

2. The embroidery machine according to claim 1, wherein each of the thread reel includes a hollow core into which one of the thread reel stand bars is inserted and the wireless tag is attached to an inner wall of the hollow core.

3. An embroidery system, comprising:

at least one embroidery machine of automatic thread-changing type including receiving means for receiving an identification of a thread wound around a thread reel from a wireless tag attached thereto;

a server device connected to the at least one embroidery machine through a network;

a database, for storing the identification of the thread and associated thread information, provided at one of an internal memory device and an external memory device of the server device; and searching means provided at the server device and searching the database for the identification of the thread received by the receiving means.

4. The embroidery system according to claim 3, wherein the server device transmits at least one of commands for thread change, thread tension regulator change, and thread density change as the thread information to the one embroidery machine or the plurality of embroidery machines on the basis of the result of the search performed by the searching means.

* * * * *